US006499203B2

(12) United States Patent
Morello

(10) Patent No.: US 6,499,203 B2
(45) Date of Patent: Dec. 31, 2002

(54) PANEL SEAMING DEVICE

(75) Inventor: Frederick Morello, Johnstown, PA (US)

(73) Assignee: MIC Industries, Reston, VA (US)

( * ) Notice: Subject to any disclaimer, the term of this patent is extended or adjusted under 35 U.S.C. 154(b) by 3 days.

(21) Appl. No.: 09/813,054

(22) Filed: Mar. 20, 2001

(65) Prior Publication Data

US 2002/0133927 A1 Sep. 26, 2002

(51) Int. Cl.[7] ..... B23P 11/00
(52) U.S. Cl. ..... 29/243.58
(58) Field of Search ..... 29/243.5, 243.57, 29/243.58; 72/51, 52, 210

(56) References Cited

U.S. PATENT DOCUMENTS

| | | | |
|---|---|---|---|
| 1,015,429 | A | 1/1912 | Fahrney |
| 4,364,253 | A | 12/1982 | Knudson |
| 4,470,186 | A | 9/1984 | Knudson |
| 4,505,084 | A | 3/1985 | Knudson |
| 4,505,143 | A | 3/1985 | Knudson |
| 5,243,748 | A | 9/1993 | Morello |
| 5,249,445 | A | 10/1993 | Morello |
| 5,318,236 | A | 6/1994 | Morello et al. |
| 5,359,871 | A | 11/1994 | Morello |
| 5,393,173 | A | 2/1995 | Morello |
| 5,469,674 | A | 11/1995 | Morello |
| 5,584,198 | A | 12/1996 | Morello et al. |
| 5,604,966 | A | 2/1997 | Morello et al. |
| 5,623,805 | A | 4/1997 | Morello |
| 5,960,662 | A | 10/1999 | Morello |
| 5,966,791 | A | 10/1999 | Morello et al. |
| 5,980,156 | A | 11/1999 | Morello et al. |

*Primary Examiner*—Robert C. Watson
(74) *Attorney, Agent, or Firm*—Blaney Harper; Jones, Day, Reavis & Pogue

(57) ABSTRACT

The present invention is a panel seaming device that can seam both curved and straight panels. The panel seaming device accomplishes this task by incorporating a unique mechanical drive configuration that includes two gear box driven by a single motor and connected by a universal joint. This mechanical drive configuration and particularly, the universal joint allows the gear boxes to pivot amongst one another, thereby accommodating for the panel's profile change. In other words, as the panel passes through the seaming device and its profile changes, especially from a straight portion to a curved portion and vice versa, the gear boxes pivot amongst each other and accommodate for such change. Additionally, each gear box includes two portions, which also pivot amongst each other in a direction perpendicular to the direction that each of the first and second gear boxes is pivot. In other words, the portions of the gear boxes pivot in a direction perpendicular to the seam. This pivoting action is made possible by utilizing worm gears within the gear box. Accordingly, the universal joint allows the gear boxes to pivot amongst each other in one direction and the worm gear arrangement of the gear boxes allows the left and right hand portions of the gear boxes to pivot amongst each other in a perpendicular direction, which is parallel to the panel seam.

30 Claims, 12 Drawing Sheets

PANEL SEAMING DEVICE

TECHNICAL FIELD

This invention relates to a seaming device and more particularly, to a seaming device capable of seaming a panel that contains both curved and straight portions.

BACKGROUND

Most buildings are constructed of a combination of columns (i.e., posts) and beams, which are covered by plywood or some sort of metal or plastic sheeting. In an effort to reduce the overall construction time, however, contractors often construct buildings, and particularly, the exterior walls of buildings, as with prefabricated building panels. Constructing a building with such panels increases efficiency because rather than assembling individual components on site, entire wall panels are manufactured on the construction site so that they can be swiftly combined and installed. These prefabricated panels are typically manufactured from steel sheet metal. Thereafter, two panels are placed adjacent to one another and the sides of the panels engage and form a sealed joint.

These interconnected panels may by straight or arched (i.e., curved) or both. Arched panels are typically used to construct an entire metal building. For example, the roof panels are completely arched and extend to the foundation. The design of these buildings is such that the roof panels continue downward and also form the side walls of the building, thereby creating a semi-circular shaped building when viewed from the end.

Regardless of whether the panel is arched or straight, it has a similar cross sectional profile. For example, FIG. 1 illustrates a cross section of a known building panel 100, which includes a central portion 102 and two inclined side wall portions 104, 106 extending from opposite ends of the central portion 102. The building panel 100 also includes two wing portions 108, 110 extending from the inclined side wall portions 104, 106, respectively. A hem portion 114 extends from one wing portion 110, and a complementary hook portion 112 extends from the other wing portion 108.

Referring to FIG. 2, there is shown a building structure 200 comprising two building panels 100 interconnected by the complementary hem 114 and hook portions 112. Referring to FIG. 2A, which is an enlarged view of the interconnected hook and hem portions, the hem portion 114 comprises an inclined hem section 120 and an end section 122. The hook portion 112 comprises a complementary inclined section 124, an intermediate section 126 parallel to the wing portions, and an end section 128. As discussed in U.S. Pat. No. 5,393,173, which is hereby incorporated by reference, the end section 122 of the hem portion 114 snaps into place adjacent the intermediate section 126 of the hook portion 112. After the hem portion snaps in place, a seaming device bends the end section 128 of the hook portion 112 up and in toward the end section 122 of the hem portion 114. Bending the end section 128, therefore, seams the two panels 100 together to form a single building structure 200.

As mentioned above, the interconnected panels may be straight or curved, an example of which is illustrated in FIG. 3. Additionally, some panels may include both straight and curved portions. The seaming devices currently used in the art, however, are unable to easily and effectively seam together panels comprised of both straight and curved sections. Such panels passing through a known seaming device and particularly, the portion of the panel that transitions from a straight to a curved portion or vice versa, tends to dislodge from or become jammed in the seaming device. When such events occur, they typically result in damaging the panel, which is an undesirable result.

Furthermore, when the panel becomes dislodged from the seaming device, it is often time consuming and difficult to reinstall the panel within the device. Moreover, most seaming devices are cumbersome to operate. Therefore, the time required to reinstall the panel can be prolonged, thereby further decreasing operational efficiency.

As previously mentioned, a sealed joint is formed by bending the end section 128 of the hook portion 112 up and in toward the end section 122 of the hem portion 114. This bending action is achieved by passing the hook and hem portions through a seaming device and particularly, between two seaming wheels. However, the building panels 100 are often wide, thereby requiring an operator to guide the seaming device across the entire width of the structure 200 to seam the interconnected joint. After the operator finishes seaming two building panels 100 together, the operator would traditionally, walk around the building structure before seaming another two building panels. This process consumes a substantial amount of time, and in an effort to increase efficiency, the operator desires to begin seaming the next two panels beginning on the side of the structure he just completed. Unfortunately, doing so requires the operator to swap the seaming wheels before seaming the next two panels. Most current techniques for switching seaming wheels are often time consuming and difficult, thereby calling into question whether it is more efficient to have the operator walk around the structure to begin seaming the next two panels rather than begin on the side which he just completed.

The foregoing features and advantages of the present invention will become more apparent in light of the following detailed description of exemplary embodiments thereof as illustrated in the accompanying drawings.

OBJECTS OF THE INVENTION

It is an object of the invention to seam a wide range of shaped panels using a singular seaming device.

It is another object of the invention to seam a panel comprised of both curved and straight panels.

It is another object of the invention to minimize the frequency that a panel becomes dislodged from the seaming device.

It is a further object of the invention to reduce the damage a seaming device imparts upon a panel.

It is a further object of the invention to improve the ease with which a panel can be reinstalled within a seaming device in to the event the panel becomes dislodged.

It is even a further object of the invention to improve the efficiency of switching seaming wheels within the seaming device.

SUMMARY OF THE INVENTION

The present invention is a panel seaming device that can seam both curved and straight panels. The panel seaming device accomplishes this task by driving two gear box and wheel assemblies with a single motor and connecting the gear boxes with a universal joint. Specifically, a motor drives a gear box, which is connected to one end of a universal joint. The other end of the universal joint is connected to a second gear box. This mechanical drive configuration and particularly, the universal joint, allows the gear boxes to pivot in at least one axial direction, thereby accommodating for the profile change of the panel. In other words, as the panel passes through the seaming device and its profile changes, especially from a straight portion to a curved portion and vice versa, the gear boxes pivot amongst each other and accommodate for such change.

Therefore, the panel seaming device of the present invention can seam a wide range of shaped panels including those that are both straight and curved.

Accordingly, the panel seaming apparatus, comprising a motor, a first gear box connected to the motor, a first wheel connected to the first gear box, a second wheel connected to the first gear box, the first and second wheels rotating in opposite directions and seaming two panels together as portions of the panels pass therebetween, a second gear box located downstream of and aligned with the first gear box along a particular axis, the second gear box connected to the first gear box via a universal joint, thereby allowing the first and second gear boxes to pivot amongst each other, a third wheel connected to the second gear box, and a fourth wheel connected to the second gearbox, the third and fourth wheels rotating in opposite directions and further seaming the panels together as the portions of the panels pass therebetween.

The gear boxes of the present invention also include two portions, which pivot amongst each other in a direction perpendicular to the direction that each of the first and second gear boxes pivot. In other words, the portions of the gear boxes pivot in a direction perpendicular to the seam. This pivoting action is made possible by utilizing worm gears within the gear box. Specifically, the worm gear arrangement allows each portion to pivot among the main worm gear shaft, which is parallel to the seam.

Because a wheel assembly is connected to each portion of the gear box, the wheel assemblies pivot along with the gear box portions. This gear box pivoting mechanism, therefore, allows the wheel assemblies to easily pivot into the appropriate seaming position. Additionally, the pivoting mechanism provides an operator access to the seaming device in the event that the panel becomes dislodged or if a jam occurs. Furthermore, once the jam is cleared, the seaming device can be quickly reinstalled around the seamed portion of the panel.

Accordingly, an alternate embodiment of the panel seaming apparatus of the present invention comprises a motor, a gear box connected to the motor, the gear box comprising a first portion and a second portion, a control lever connected to and pivoting about the first portion of the gear box, an extension arm comprising a first end and second end, the second end connected to the second portion of the gear box, and the first end connected to the control lever such that when the control lever pivots about the first portion of the gear box, the first and second gear box portions pivot amongst one another, a first wheel connected to the first portion of the gear box, and a second wheel connected to the second portion of the gear box, the first and second wheels rotate in opposite directions and seam two panels together as portions of the panels pass therebetween.

In a further embodiment of the present invention, the seaming device includes a quick release mechanism that allows the seaming wheels to be quickly and easily removed from the shafts of the gear boxes. The quick release design of the shaft and seaming wheels allows an operator to efficiently switch seaming wheels within a seaming device. This embodiment of the invention is made possible by including a cam-type design between the shaft and seaming wheel. Particularly, the shaft includes two winged portions at its end that connect to the seaming wheel. The seaming wheel includes a complementary opening and bore design that allows the shaft to turn and lock into place after entering through the opening within the seaming wheel.

Accordingly, the other alternate embodiment of the panel seaming apparatus of the present invention comprises a gear box, means for driving the gear box, a first shaft comprising a first end and a second end, the first end connected to the gear box, the second end comprising at least two winged portions, a first wheel comprising a hub, the hub comprising, an opening for receiving the second end of the first shaft, and a butterfly it shaped bore for allowing the second end to turn within the first wheel after entering through the opening, a second shaft comprising a first end and a second end, the first end connected to the gear box, the second end comprising at least two winged portions, and a second wheel comprising a hub, the hub comprising an opening for receiving the second end of the second shaft, and a butterfly shaped bore for allowing the second end of the second shaft to turn within the second wheel after entering through the opening, the first and second wheels rotate in opposite directions and seam two panels together as portions of the panels pass therebetween.

DESCRIPTION OF THE PREFERRED EMBODIMENTS

Figure 1:
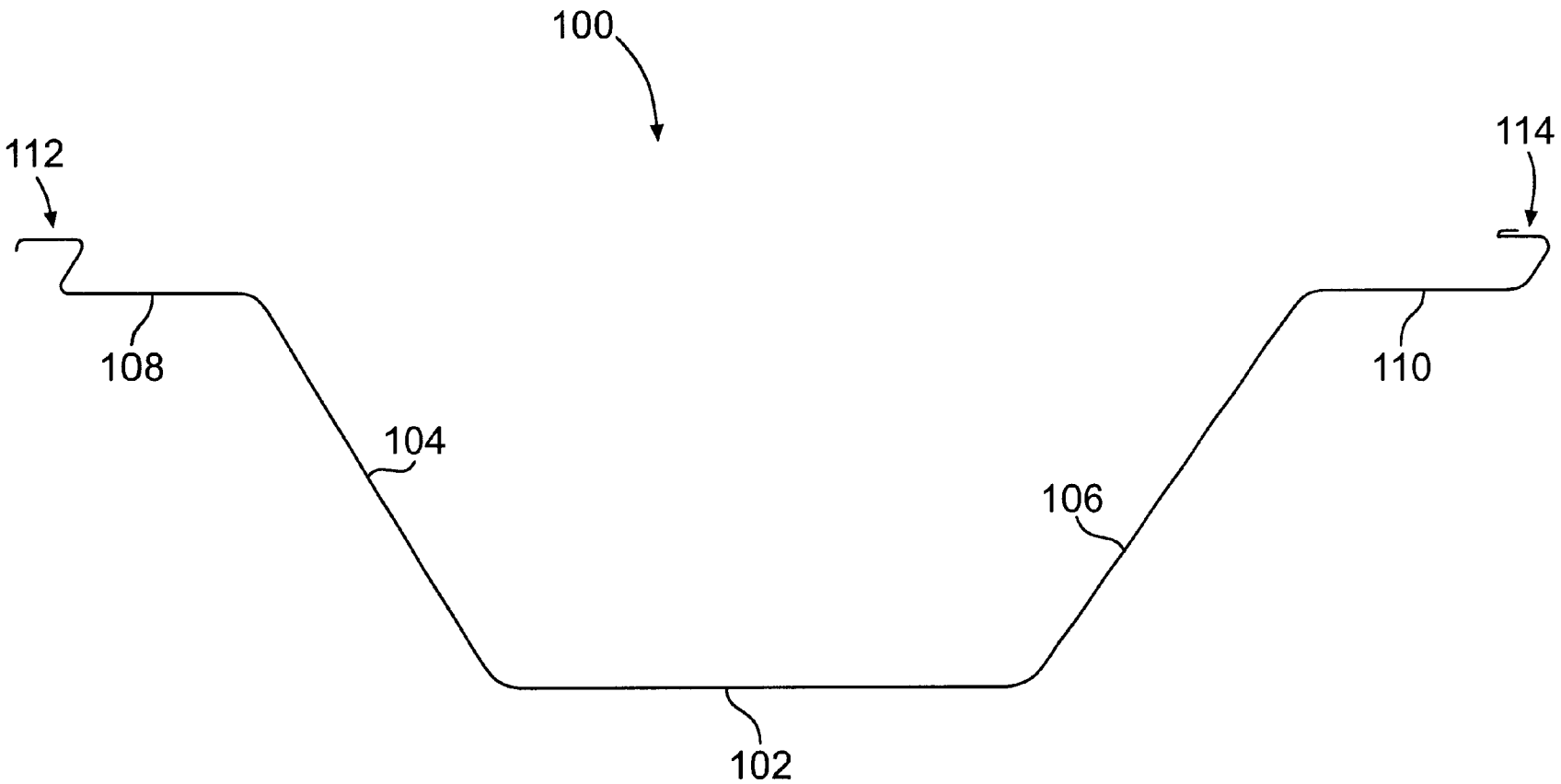
FIG. 1 is a cross sectional view of one example of a known building panel 100.
Figures 2, 2A:
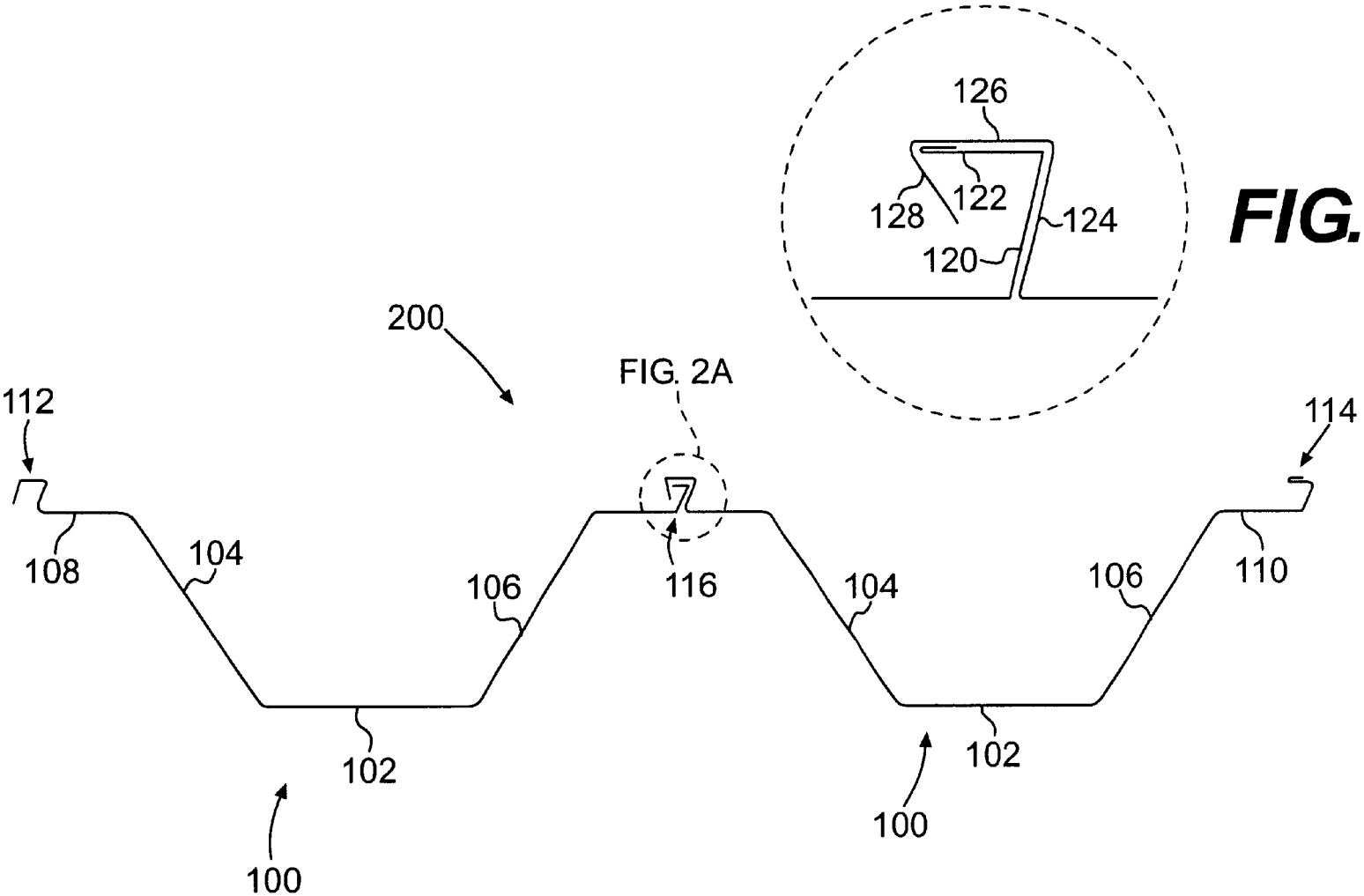
FIG. 2 is a cross sectional view of an example of a building structure 200 comprised of plurality of building panels 100 illustrated in FIG. 1.
FIG. 2A is an enlarged view of the seamed portion of the building structure illustrated in FIG. 2.
Figure 3:
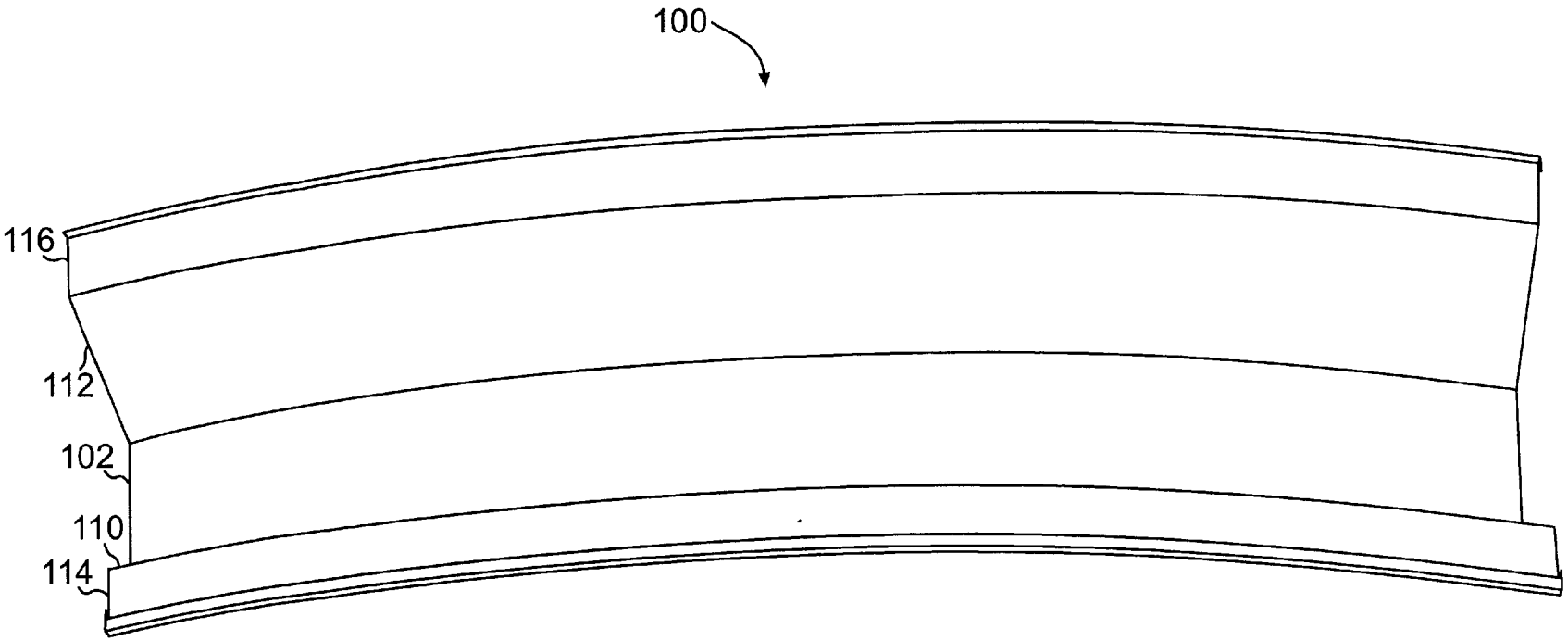
FIG. 3 is a perspective view of the known building panel illustrated in FIG. 1.
Figure 4:
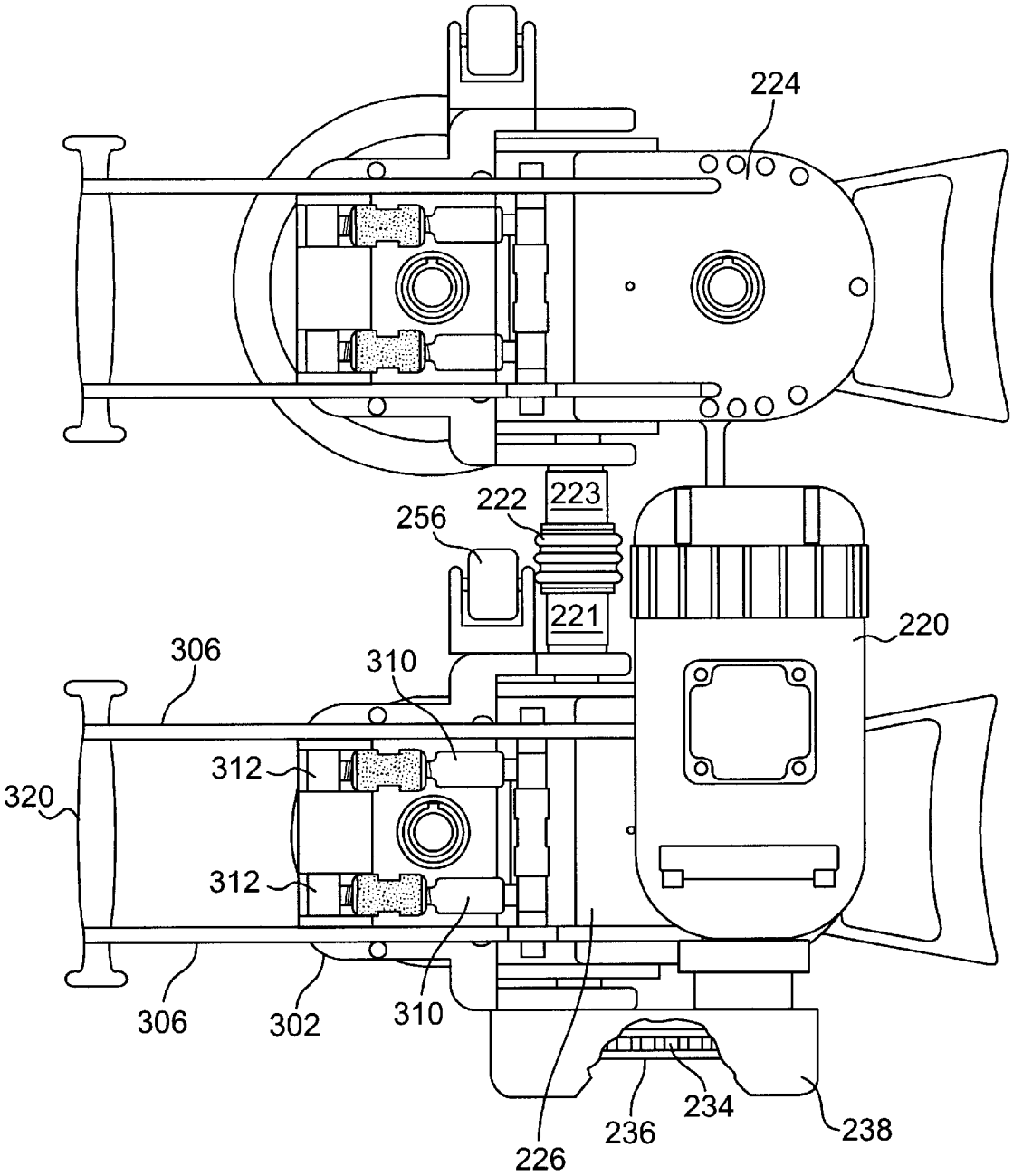
FIG. 4 is a plan view of one embodiment of the seaming device of the present invention including two gear boxes 224, 226 both driven by a single motor 220 and connected via a universal joint 222.
Figure 5:
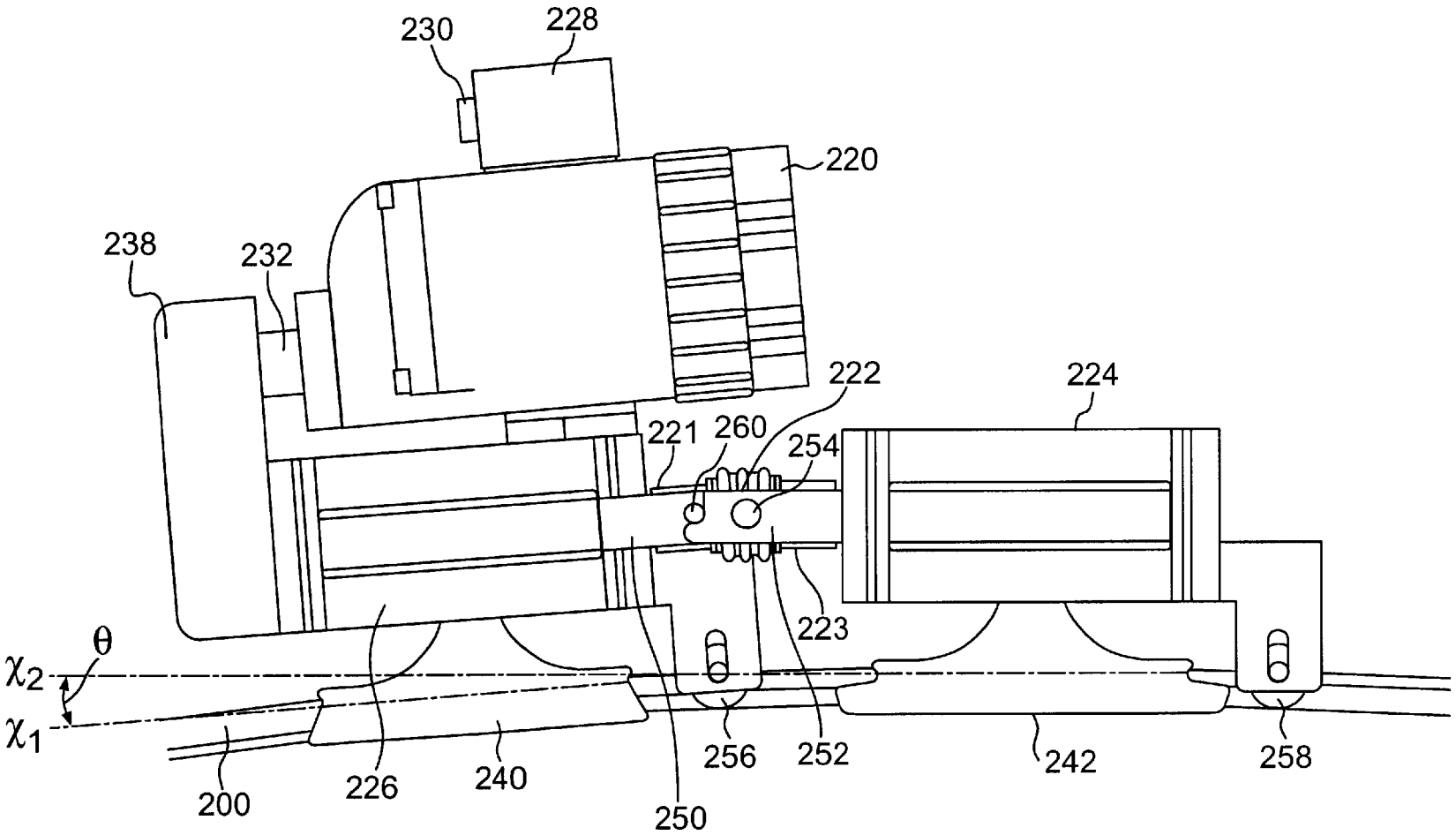
FIG. 5 is a is an elevation view of the embodiment illustrated in FIG. 4.

Referring to FIGS. 4 and 5, one embodiment of the present invention is a seaming device that includes an electric motor 220 and two gear boxes 224, 226 connected together via a universal joint 222. The electric motor 220 is connected to the upstream gear box 226 via a sprocket and chain arrangement. Specifically, a sprocket 234 is attached to a shaft 232 extending from the motor 220, and a chain 236 wraps around the sprocket 234, as well as another sprocket (not shown) that is connected to a shaft (not shown), which extends from the gear box 226. Although this particular embodiment illustrates a sprocket and chain arrangement, it shall be understood that the present invention may include other means for connecting the motor 220 to the gear box 226 or other means for driving the gear box 226, such as a belt and pulley arrangement, direct coupling the motor to the gear box shaft, etc. Regardless of which type of means is used to mechanically link the motor 220 to the gear box 226, it is preferable to cover such linkage with a guard 238.

As illustrated in FIG. 4, gear boxes 224, 226 are aligned along a particular plane. As discussed above, one end of gear box 226 is connected to the motor 220. Extending from the opposite end of the gear box 226 is a drive shaft 221, which, in turn, is connected to one end of a universal joint 222. The other end of the universal joint 222 is connected to another drive shaft 223 that extends from a second gear box 224. Also extending from each gear box 224, 226 at an angle perpendicular to the shafts 221, 223, are wheels (i.e., rollers) that seam together the hook and hem portions of the panels 100 as they pass through the wheels 240, 241, 242, 223, which will be discussed in further detail below.

Upon pressing the button 230 on the switch 228 into the "ON" position, the motor 230 engages and turns the gears within the gear box 226. It shall be understood that the present invention is not limited to an electric motor and could include other types of motors, such as hydraulic motors, air motors, etc. Additionally, the motor need not be controlled by a switch 228 mounted directly on the motor. Rather the motor 220 could be controlled by more complicated switching techniques or control systems known in the art.

Upon engaging the motor 220, the gear box 226 turns the shafts 221, 223 and universal joint 222, thereby transferring power from the motor 220 to the second gear box 224. Hence, the need for a second motor is removed. More importantly, the universal joint 222 transfers rotary motion from one gear box to the other and allows the gear boxes 224, 226 to pivot amongst one another. Because the gear boxes 224, 226 can pivot about the universal joint 222, they are able to seam a panel 200 comprising both straight and curved sections. Pivoting the gear boxes also reduces the possibility that such a panel will become dislodged from the seaming device, thereby minimizing the potential damage to the panel.

As illustrated in FIG. 5, the imaginary horizontal axis of the first gear box 226 is designated as $x_1$, and the imaginary horizontal axis of the second gear box 224 is designated as $x_2$. The angle ($\theta$) between axes $x_1$, and $x_2$ is referred to as the pivot angle, which represents the angle that the two gear boxes can pivot amongst each other. The pivot angle ($\theta$) is limited by a mechanical linkage system comprised of a link arm 250 affixed to the first gear box 226, another link arm 252 affixed to the second gear box 224, and a hinge pin 254 connecting the link arms 250, 252 that also allows them to pivot thereabout. The hinge pin 254 is aligned with the center of the universal joint 222 to allow the gear boxes to pivot about the center of the universal joint 222. However, a locking pin 260 is attached to one of the link arms 250, and the other link arm 252 has a complementary countered design such that link arm 252 contacts the locking pin 260 after the first and/or second gear boxes 224, 226 pivot a certain angular range. It is preferable to design link arms 250, 252 and locate the locking pin 260 in a location such that the gear boxes 224, 226 pivot at about 0° to 90°, and it is even more preferable to design the linkage system such that the pivot angle can range from about 0° to 25°. Although FIG. 5 only illustrates one set of link arms it is preferable that the linkage system include two sets of link arms such that there is one set on each side of the universal joint 222.

Continuing to refer to FIG. 5, as the panel 200 passes through the seaming wheels 240, 241, 242, 243, the gear boxes 224, 226 pivot about the hinge pin 254 and adapt to the shape of the panel 200. As the panel 200 travels from the seaming wheels 240, 241 to the other seaming wheels 242, 243, the panel 200 may tend to become misaligned or buckle. Therefore, it may be preferable to add an idler roll 256 between the gear boxes to maintain the panel's proper alignment and minimize the possibility of it buckling. The idler roll 256 is connected to the first gear box 226 by a bracket. Additionally, it may be preferable for the idler roll 256 to include a polyurethane coating or be constructed of a similar material to provide the proper amount of surface tension and to minimize the possibility of damage to the panel. Furthermore, it may be preferable to include a second idler roll 258 for a similar purpose at the exit of the seaming wheel 242.

Figure 6:
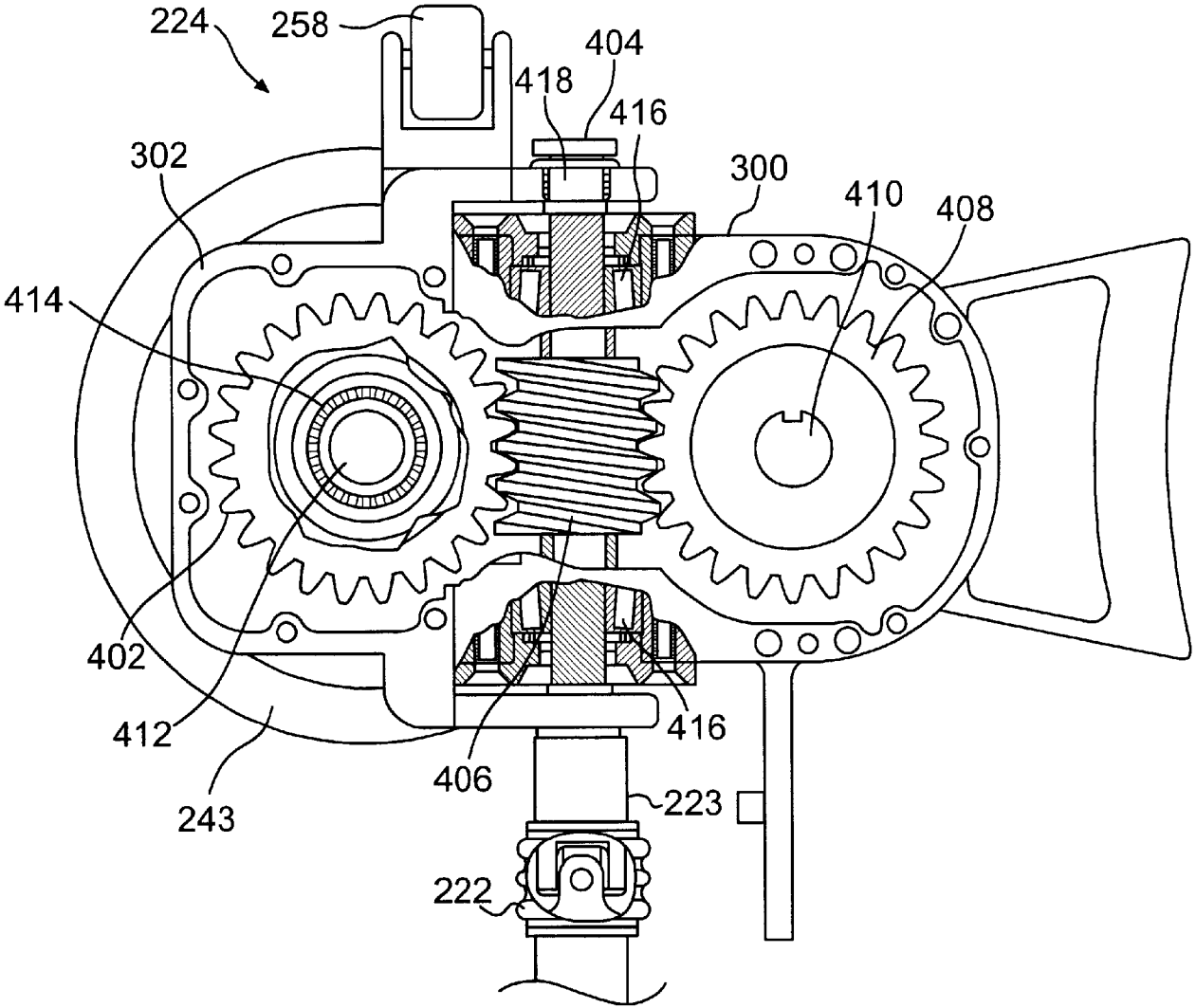
FIG. 6 is a sectional view of a preferred embodiment of the gear boxes 24, 26 illustrated in FIGS. 4 and 5.

As mentioned above, when the panel becomes dislodged from a currently available seaming device or when the panel becomes jammed therein, it is often difficult and time consuming to properly reinstall the panel within the device. The present invention reduces the difficulty of reinstalling the panel because the gear boxes 224, 226 illustrated in FIGS. 4 and 5 include two portions that are able to pivot amongst one another in a direction perpendicular to the seam. Referring to FIG. 6, there is shown a sectional view of a preferred configuration of gear box 224. The gear box 224 comprises two distinct portions 300, 302 each comprising a worm gear 408, 402. The gear box 224 also includes a main driving worm gear 406 that is connected to a shaft 223. As the shaft 223 rotates, so does the driving worm gear 406, which transfers rotary motion to the complementary worm gears 408, 402.

The shaft 223 is mounted in what is shown as the right hand portion 300 of the gear box. Specifically, the shaft 223 slides through bearings 416, which are mounted in the right hand portion of the gear box. Mounting the shaft within the bearings 416, which are, in turn, mounted in the right hand portion 300 of the gear box allows that portion of the gear box to rotate about the shaft 223.

Similarly, the left hand portion 302 of the gear box is also mounted on the shaft 223. Although the left hand portion 302 is mounted on the exterior of the right hand portion 300, the shaft 223 slides through an additional set of bearings 418 mounted within the left hand portion 302, thereby allowing the left hand portion 302 to rotate about the shaft. Therefore, both the left and right hand portions 302, 308 of the gear box are able to pivot about the driven worm gear shaft 223, which is typically aligned with the seam of the panel.

Because the seaming wheels are connected to the left and right hand portions of the gear box, the seaming wheels also pivot about the seamed panel, thereby allowing an operator to easily remove any jams and quickly reinstall the panel into the seaming device. Continuing to refer to FIG. 6, the gear 402 is connected to a shaft 412, which rotates the seaming wheel 243. Specifically, the gear 402 is mounted over and keyed into the shaft 412. The shaft 412 also slides through a bearing 414, which separates the shaft 412 from the left hand portion 302 of the gearbox. The right hand portion 300 of the gear box has a similar configuration. Therefore, as the worm gear 406 turns, the seaming wheels 243 and 242 rotate in opposite directions, thereby pulling the panel 200 through the wheels and seaming it. Additionally, as the left 302 and right 300 hand portions of the gear box pivot about the driving worm gear 406, the gap between the seaming wheels 242, 243 increases or decreases accordingly.

Furthermore, because the gear box includes a worm gear configuration, the gears 402, 406, 408 remain in contact and continuously mesh as the left 302 and/or right hand 300 portions pivot about the main driving gear 406. Although the discussion above pertaining to FIG. 6 has related only to gear box 224, the purpose of doing so is to simplify the disclosure. However, it shall be understood that gear box 226, which is located upstream of gear box 224, however, has a similar configuration to gear box 224.

Because gear box 224 is downstream of gear box 226, the main driving gear 406 of gear box 224, as illustrated in FIG. 6, is directly driven by the shaft 223, which is connected to the universal joint 222. Assuming that gear box 226 has a similar configuration to gear box 224, the motor 220 is connected to the opposite end 404 of the shaft 221. Thus, the motor 222 directly drives the main drive gear 406 of gear box 226 and indirectly drives the main drive gear 406 of gear box 224 because the main drive gears from each gear box are connected via shaft 221, 223 and the universal joint 222. Accordingly, the universal joint 222 allows the gear boxes 224, 226 to pivot amongst each other in one direction (i.e., perpendicular to the panel seam) and the worm gear arrangement of the gear boxes allows the left 302 and right 300 hand portions of the gear boxes to pivot amongst each other in a perpendicular direction, which is parallel to the panel seam.

Referring to FIGS. 7–10, pivoting the left 302 and right 300 hand portions of the gear boxes is controlled by an articulating arm arrangement. The articulating arm arrangement comprises a control lever 306 and an extension arm 308. One end of the control lever 306 is connected to the right hand portion 300 of the gear box by a pivot pin 318, and the other end of the control lever 306 has a handle 320. One end of the extension arm 308 is connected to the control lever 306 via a pivot pin 316, and the other end of the extension arm 308 is connected to the left hand portion 302 of the gear box via a bracket 314 and pivot pin 322. As the control lever 306 pivots about pivot pin 318, the left and right portions 302, 200 of the gear box pivot about main drive gear 406.

Specifically, as the control lever 306 rotates upward, the portion of the extension arm 308 connected to the control lever 306 also moves upward, thereby causing the tops of the left and right portions 302, 300 of the gear box to pivot up and inward. As the tops of the left and right portions approximate one another, the seaming wheels 243, 242, extending from the bottom of the left and right portions, move away from one another, thereby increasing the gap between the seaming wheels 243, 242. Conversely, as the control lever 306 rotates downward, the corresponding portion of the extension arm 308 also moves down and outward, thereby decreasing the gap between the seaming wheels 243, 242.

Figure 7:
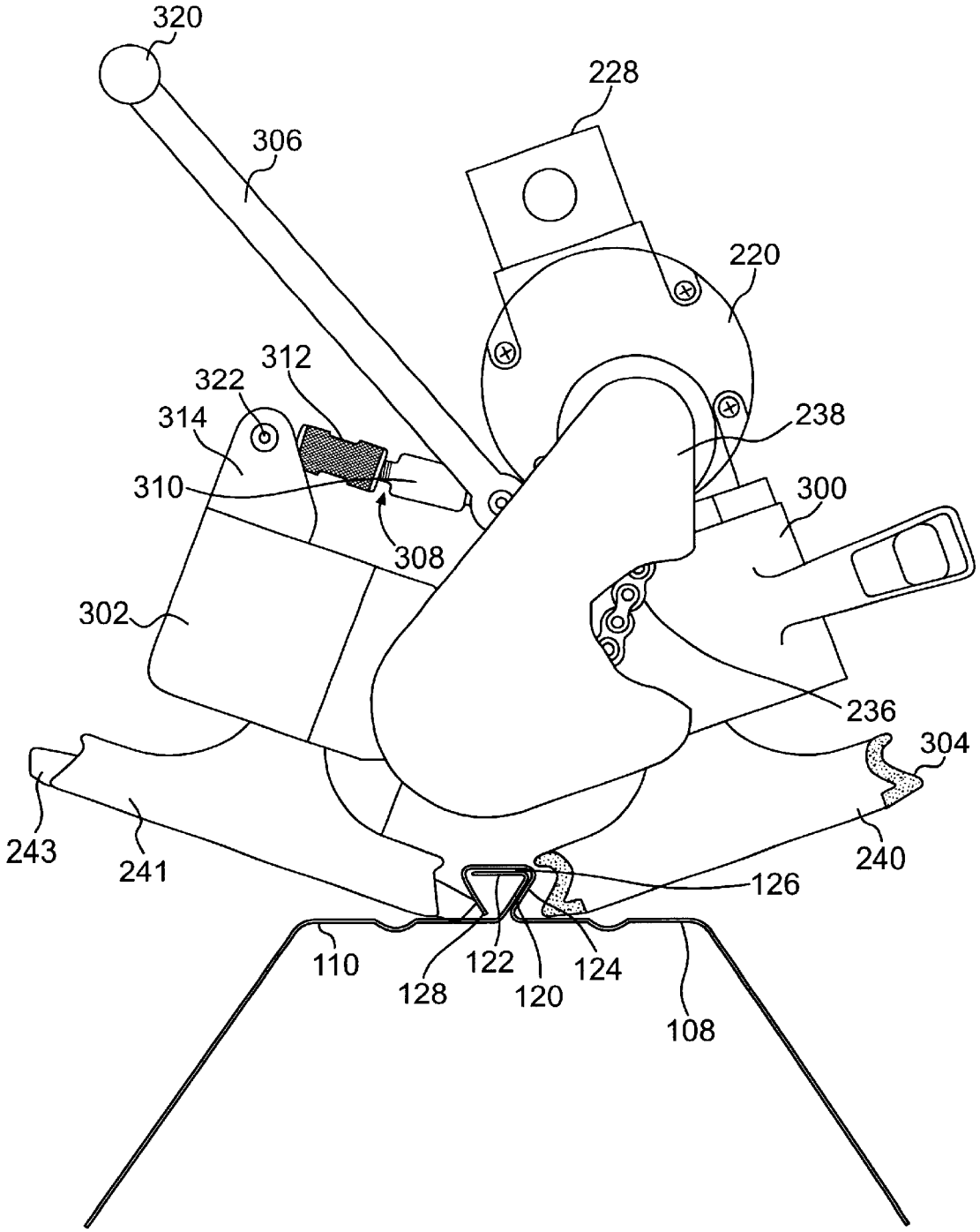
FIG. 7 is an elevation view of another embodiment of the seaming device of the present invention including an upstream gear box 226 with its two portions in an open position over a building structure comprised of two panels.

Referring particularly to FIG. 7, there is illustrated the upstream gear box 226 that is directly connected to the motor 220. The upstream gear box is in a fully open position because the seaming wheels 240, 241 do not contact the hook and hem portions of the panels. More specifically, this figure illustrates a seaming wheel 241 extending from the left hand portion 302 of the gear box 226, wherein the seaming wheel 241 has a profile complementary to the intermediate 126 and end 128 sections of the hook portion 112 of the panel. Additionally, the upstream gear box 226 includes another seaming wheel having a different profile that is complementary to the inclined 124 and intermediate 126 sections of the hook. Thus, when the control lever 306 is in an upright position, the seaming wheels 241, 242 are spread apart and fail to contact the seam, thereby allowing an operator to easily install the panel 200 into the seaming device.

Although FIG. 7 primarily illustrates upstream gear box 226, this figure also illustrates seaming wheel 243 of the downstream gear box 224. Seaming wheel 243 has a different profile than seaming wheel 241. Specifically, seaming wheel 243 has a larger diameter than seaming wheel 241. However, seaming wheels 240 and 242 have substantially the same diameter. Therefore, as will be discussed in more detail below, when the panels pass between the first set of seaming wheels 240 and 241, those wheels partially seam the panels, and when then panels pass between the second set of downstream seaming wheels 242 and 243, those wheels complete the seaming process by bending the end section 128 of the hook portion 112 of one panel up toward the end section 122 of the hem portion 114 of the other panel. The second set of seaming wheels 242, 243 are referred to as downstream of the first set of seaming wheels 240, 241 because the panel first passes through the first set of seaming wheels and thereafter travels to the second set.

Figure 8:
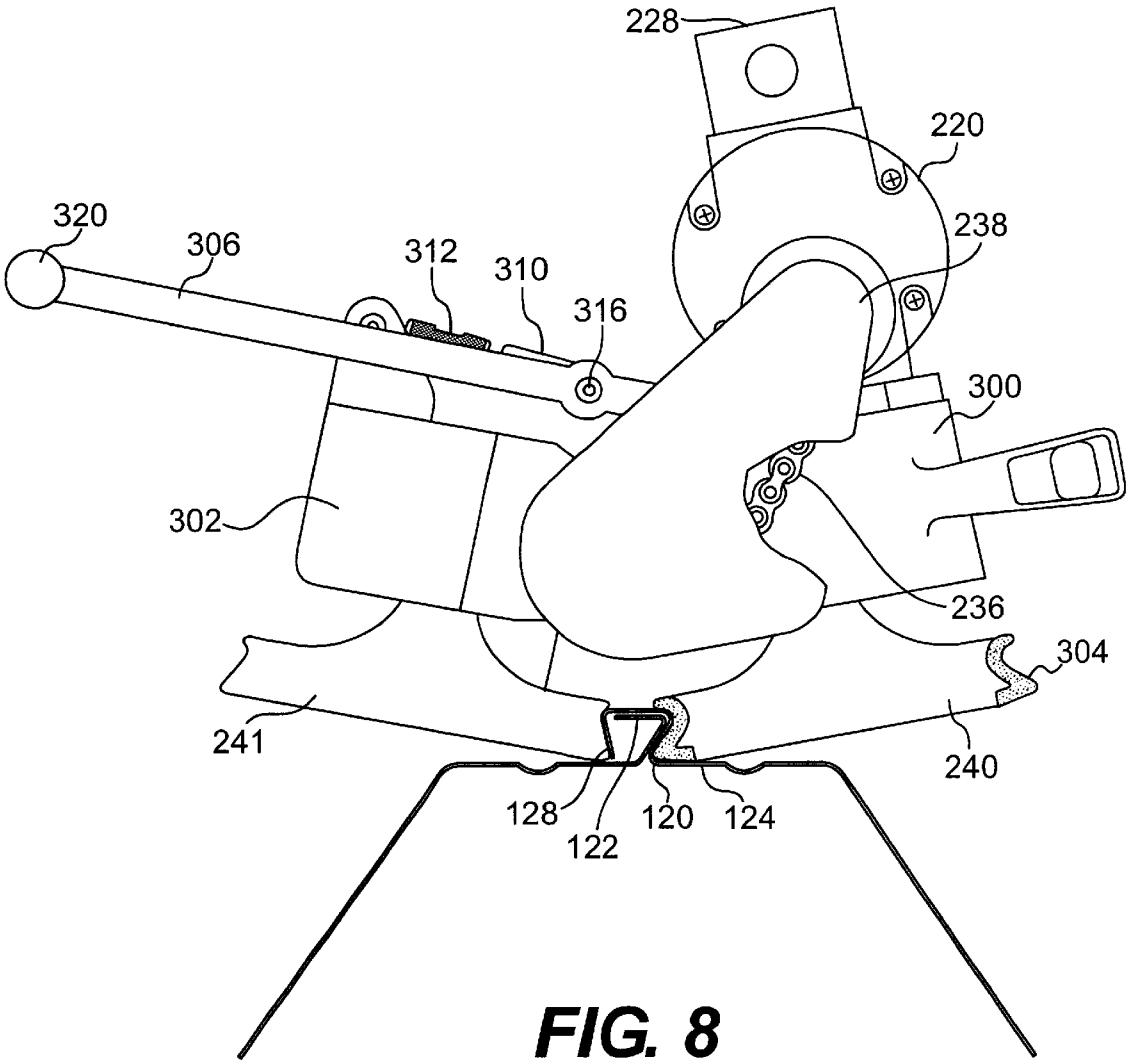
FIG. 8 is an elevation view of the seaming device illustrated in FIG. 7, and particularly, the upstream gear box 226 in a locked position.

Referring to FIG. 8, when the control lever 306 rotates down and outward and becomes substantially parallel to the extension arm 308, the upstream gear box 226 locks into position. As mentioned above, seaming wheel 241 has a profile that is complementary to the intermediate 126 and end 128 sections of the hook portion of the panel, and seaming wheel 240 has a profile that is complementary to the inclined 124 and intermediate 126 portion of the hem portion. When the control lever 306 is in the locked position, the seaming wheels 240, 241 do not contact one another but are spaced apart such that when the interlocked hem and hook portions of the panels enter the gap between wheels, the seaming wheels 240, 241 begin to seam the portions of the two panels together by bending the end 128 section of the hook portion 112 up toward the end section 122 of the hem portion 114.

Figure 9:
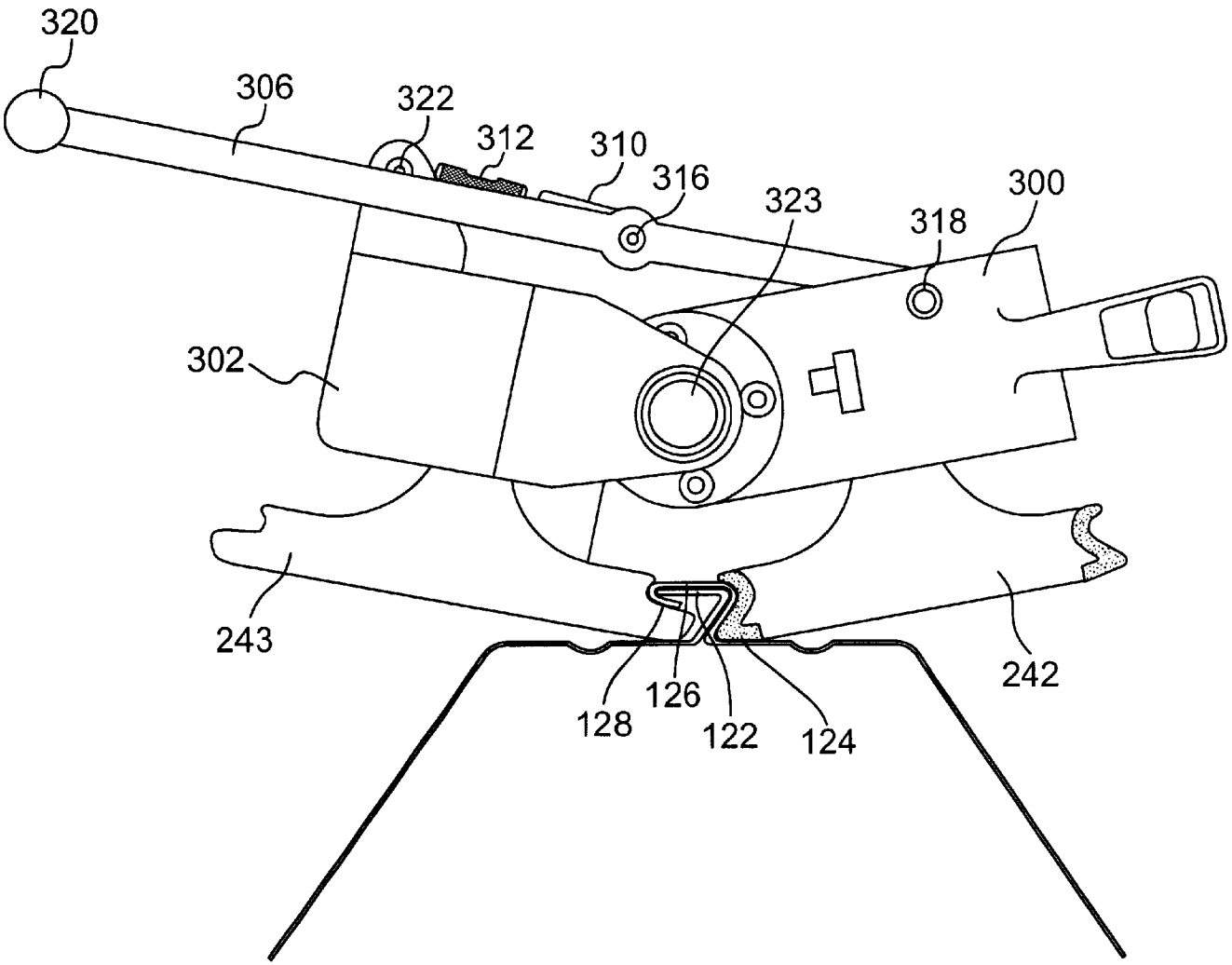
FIG. 9 is an elevation view of the seaming device illustrated in FIG. 7, and particularly, the downstream gear box 224 in a locked position.

Referring to FIG. 9, the seaming process is completed by passing the partially seamed hem and hook portions through a second set of seaming wheels 242, 243. The locked gear box configuration of FIG. 9 is similar to that illustrated in FIG. 8. However, FIG. 8 illustrates gear box 226 that is directly driven by the motor 220, while FIG. 9 illustrates gear box 224, which is driven by shaft 223 that is connected to the universal joint 222. In order to complete the seaming process, seaming wheel 241 has a larger diameter and different profile than seaming wheel 241. Specifically, seaming wheel 243 is designed such that when the partially seamed hem and hook portions enter the gap between the second set of seaming wheels, seaming wheel 243 bends the end section 128 of the hook portion further up toward the end section 122 of the hem portion. As with seaming wheel 240, seaming wheel 242 holds the inclined 124 and intermediate 126 sections of the hook portion of the panel in place while the inclined section 128 is being bent by seaming wheel 243. Moreover, it may be preferable for seaming wheel 240 to be coated with polyurethane in order to minimize its wear and prevent damage to the panel.

As mentioned above, when the control lever 306 pivots downward and becomes substantially parallel to the extension arm 308, it locks into position. Specifically, the seaming device includes an over-center locking mechanism. Thus, when the as control lever 306 pivots and attains a position such that pivot pin 316 is below the plane comprising pivot pin 318 and pivot pin 322, the left and right hand portions of the gear box lock into position.

Figure 10:
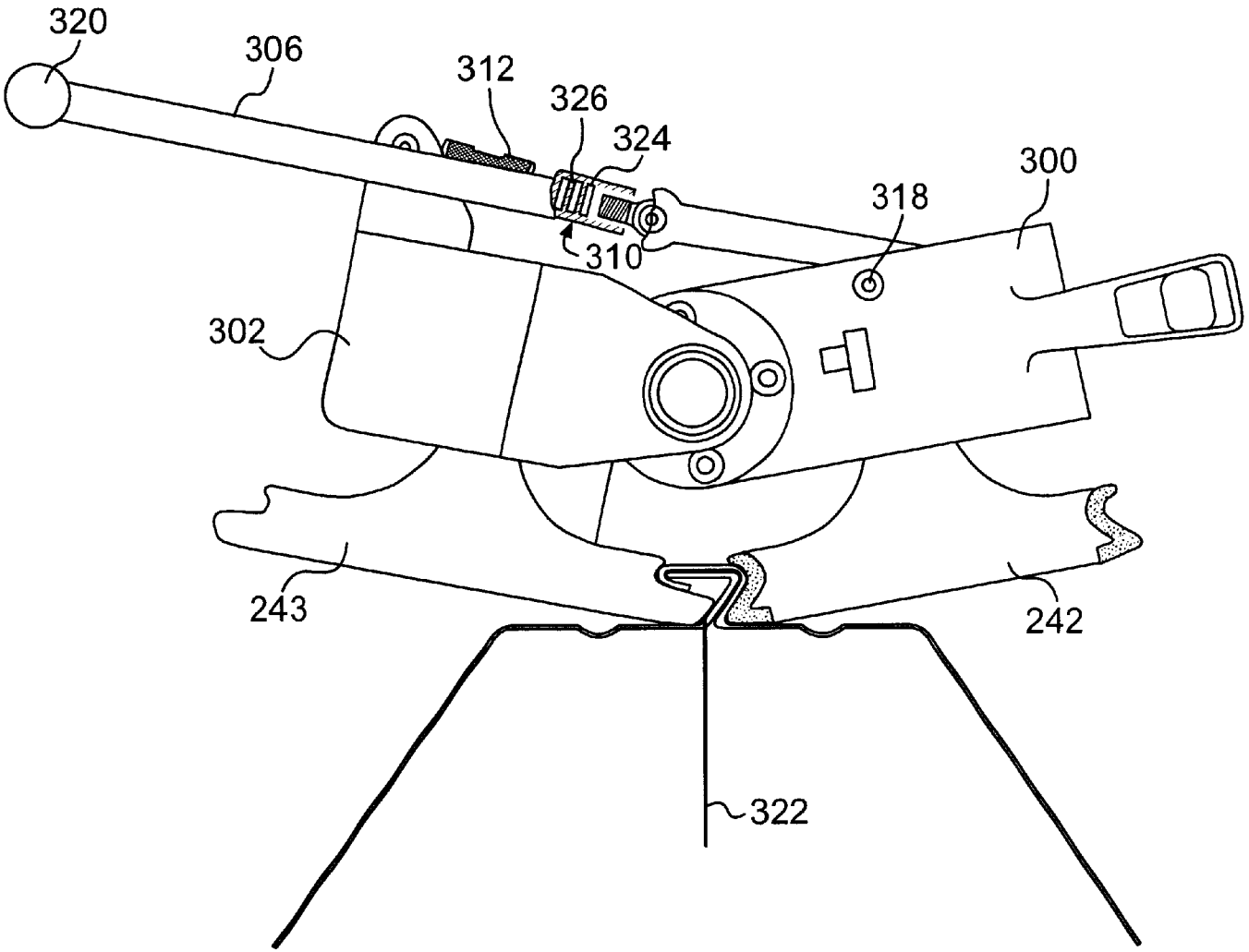
FIG. 10 is a more detailed elevation view of the seaming device and gear box illustrated in FIG. 9.

As illustrated in FIG. 10, it may be preferable to include a means for allowing the extension arm 308 to suddenly absorb a sudden load change. For example, it is often desirable to include tabs (i.e., hangers) 322 within the building structure. These tabs 322 are often used to hang lighting or plumbing fixtures within the building, and one method of affixing the tabs 322 to the building structure is seaming them between the individual panels. Similar to the hook and hem portions of the panel, the tab 322 includes an inclined section and an end section. The tab's inclined section is inserted between the hook's inclined section and the hem's inclined section. Additionally, the tab's end section is inserted between the hem's end section and the hook's intermediate section. Thus, when the hook and hem portion are seamed, so is the tab 322.

The gap between the seaming wheels 242, 243 is typically set to seam only the hook and hem portions, but the tab tends to increase the thickness of the seamed portion. Thus, when a seamed portion that includes a tab 322 passes between the seaming wheels 242, 243, the extra thick seamed portion tends to exert a reactionary force on the seaming wheels, and the reaction force is eventually transferred back to the extension arm 308. Hence, it is preferable for the extension arm 308 to accommodate for this sudden change, and one such means of accommodating for this change includes inserting a compression spring 310 within the extension arm 308.

The compression spring can be of a type known in the art, such as those constructed of steel or other types of metal. However, it may be preferable to use a type of compression is spring that is illustrated in FIG. 10. Specifically, compression spring 310 comprises multiple polyurethane springs 324 separated by steel washers 326. Although one polyurethane spring may be sufficient it is preferable to utilize additional springs because adding springs increases the extension arm's flexibility. However, if multiple polyurethane springs 324 are used, it is preferable to insert a washer 326 between each spring because doing so assists in distributing the load evenly among each individual spring 324. Therefore, as the seaming wheels 242, 243 encounter a change in the gap, due to an object increasing or decreasing the seaming portion's thickness, the compression spring 310 and particularly, the individual polyurethane springs 324, absorb the reactionary force.

It may also be preferable to include a means for adjusting the length of the extension arm 306. One such means may include inserting an adjustment mechanism 312, such as a threaded nut and rod assembly as illustrated in FIGS. 7–10. The threaded nut and rod assembly comprises two individual rods and a nut connecting the rods. One rod has a left hand thread and the other has a right hand thread. Thus, when the screw turns in one direction, the rods approximate one another, and when the screw turns in the opposite direction, the rods spread apart, thereby increasing the length of the extension arm. Inserting such an assembly will allow an operator to easily and quickly change the length of the extension arm 306, which, in turn, alters the gap between the seaming wheels 242, 243. Having the ability to adjust the gap between the seaming wheels 242, 243 allows the seaming device to seam a wider range of panels having variable thickness. The spring, locking, and adjusting means have been discussed with regard to one articulating mechanism having one control lever and extension arm because FIGS. 7–10 only illustrate one control lever and extension arm. However, it shall be understood that it is preferable for each left hand portion of the gear box to have a pair of control levers and extension arms attached to it as illustrated in FIG. 4.

Figure 11:
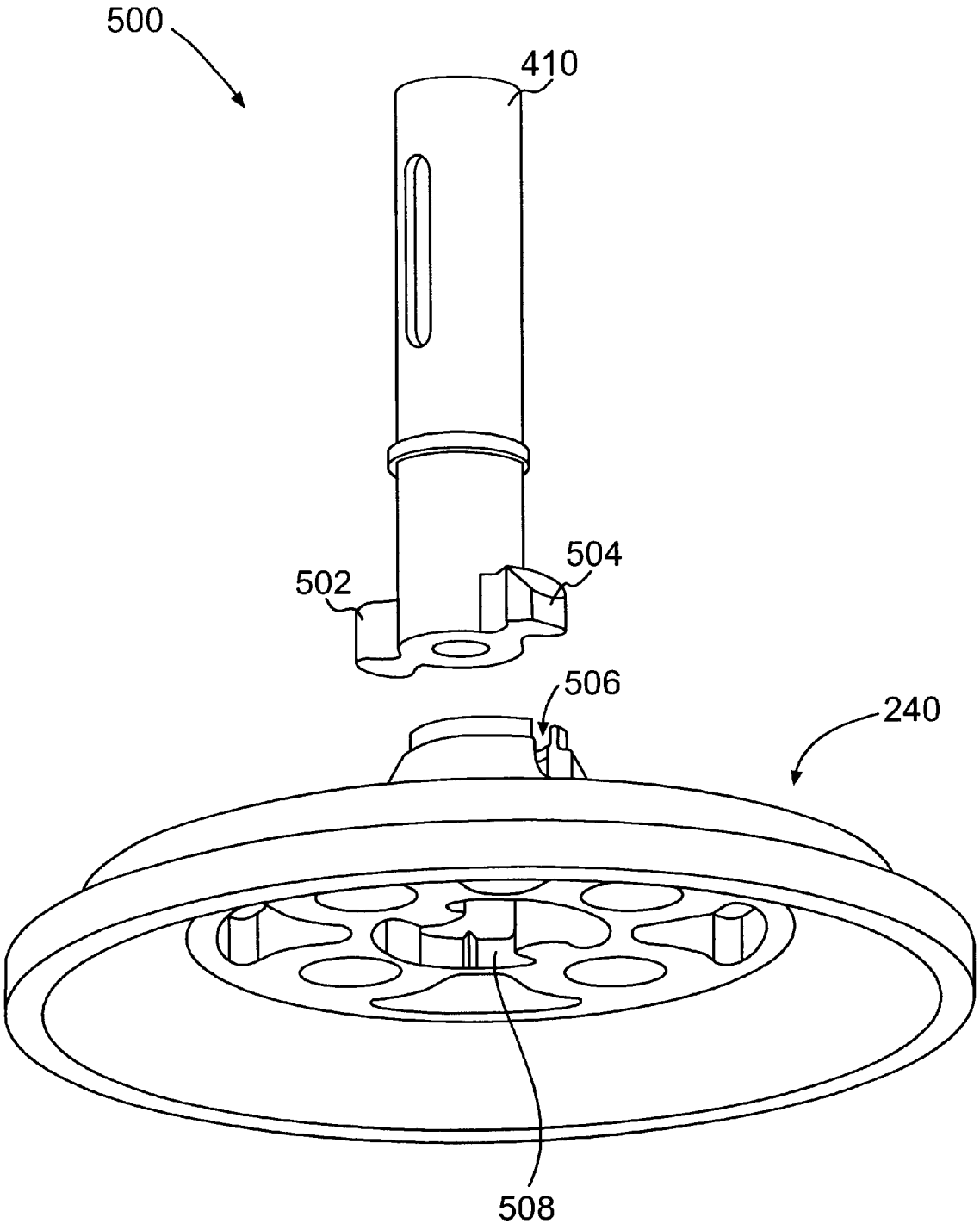
FIG. 11 is an isometric view of further embodiment of the seaming device of the present invention including a shaft 410 comprising a cam-type end with two winged portions 502, 504 and a wheel 240 having a complementary bore 508.
Figure 12:
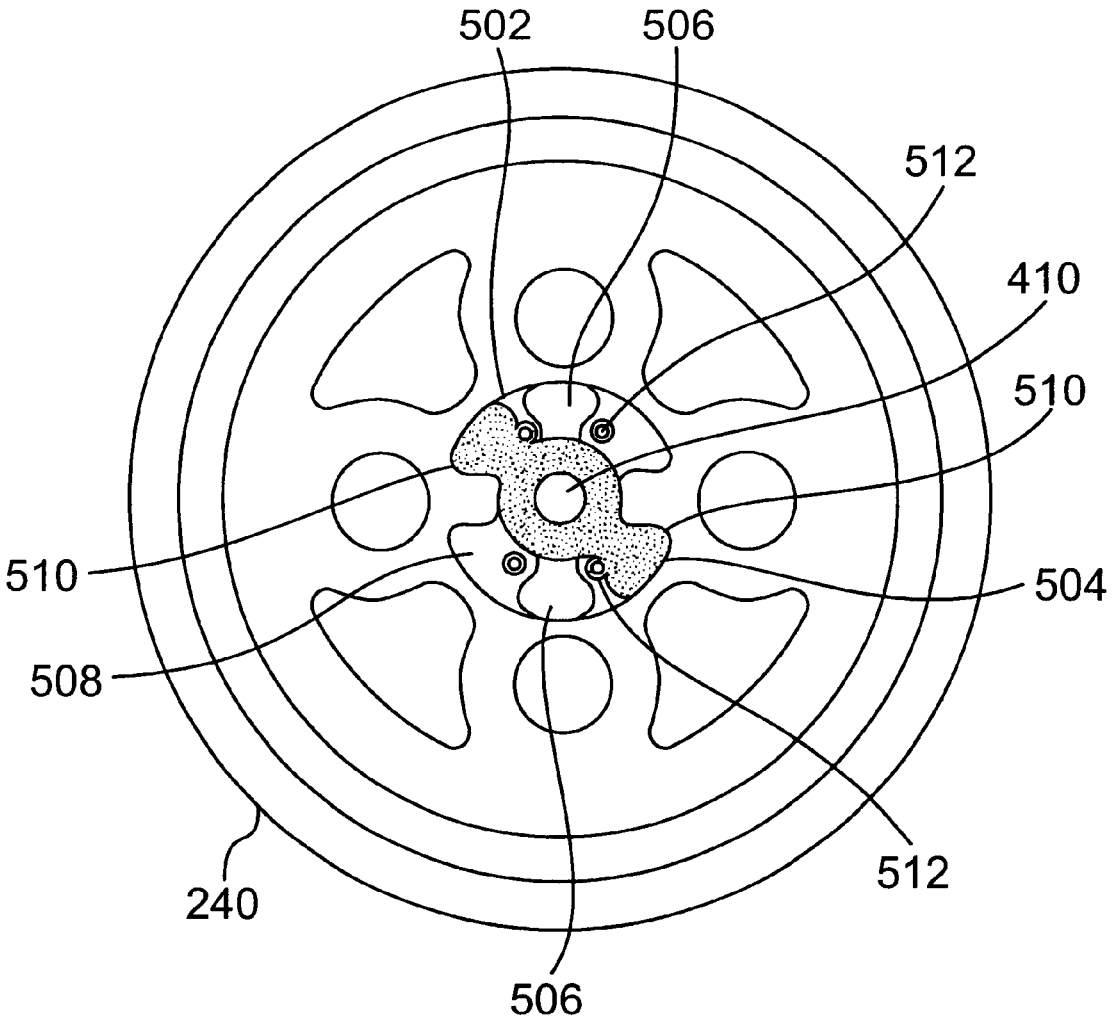
FIG. 12 is a plan view of the embodiment illustrated in FIG. 11, wherein the winged portions 502, 504 of the shaft 410 have been inserted into the wheel 240 through an opening 506 and turned within a butterfly shaped bore 508.

Referring to FIGS. 11 and 12, there is shown an alternate embodiment of the seaming apparatus of the present invention. As previously mentioned, it is often desirable to switch the seaming wheels from one portion of the gear box to the other. Furthermore, it is preferable to perform this swapping task quickly and efficiently as possible. Thus, the embodiment illustrated in these two figures includes a quick release function, which allows an operator to rapidly remove one seaming wheel from one gear box shaft and attach it to the other gear box shaft.

The quick release feature 500 comprises a shaft 410 extending from the right hand portion 300 of gear box 224. Although the quick release feature is described in reference to the right hand portion of one gear box, it shall be understood that this feature can be included within the left hand portion, as well as other gear boxes. One end of the shaft 410 is connected via a key to worm gear 408 of gear box 224, and the other end of the shaft 410 is connected to seaming wheel 240. It is the connection between the shaft 410 and the seaming wheel 240 that includes the quick release feature.

The end of the shaft 410 that connects to the seaming wheel 240 has two winged portions 502, 504 extending from its circumference. The seaming wheel 240, in turn, has an opening 506 that is complementary to the winged portions 502, 504. Additionally, the seaming wheel 240 includes a bore 508 below the opening 506, thereby allowing the winged portions 502, 504 to turn within the bore 508 after that end of the shaft 410 enters the wheel through the opening 506. It is preferable for the bore 508 to have a shape complementary to the winged portions 502, 504, and it is even more preferable for the bore to have a shape similar to a butterfly, as illustrated in FIGS. 11 and 12. Therefore, as the winged portions 502, 504 rotate within the bore 508, they will firmly butt up against the end 510 of the bore 508 and lock in place.

It may also be preferable to include ball plungers 512 within the seaming wheel 240. Ball plungers 512 are typically metal balls behind which there is a spring. Thus, as the winged portions 502, 504 rotate within the bore 508, the winged portions 502, 504 pass over the ball plungers 512 and the ball plungers 512 retract into the wheel. After the winged portions 502, 504 pass over the ball plungers 512 and butt up against the end of the ends 510 of the bore 508, the ball plungers 512 extend and lock the winged portions 502, 504 in place. In other words, after the winged portions 502, 504 pass over the ball plungers 512, the ball plungers 512 assist in preventing the winged portions 502, 504 from turning in an alternate direction.

The ball plungers 512, however, are appropriately sized such that the seaming wheel 240 may be removed from shaft 410. In other words, the benefit of the quick release feature is to quickly change seaming wheels from one gear box shaft to the other. Thus, the ball plungers 512 are sized such that the winged portions 502, 504 lock in place after being turned in a certain direction but allow for an operator to turn the seaming wheel 240 in an opposite direction so that the seaming wheel 240 may be removed from shaft 410 and placed on another shaft.

As mentioned above, the shape of the bore 508 is similar to a butterfly. This shape allows the shaft 410 or wheel 240 to turn approximately 45° before the winged portions 502, 504 pass over the ball plungers 512 and lock in place, thereby minimizing the amount of rotation required to fasten the wheel to the shaft, which, in turn, decreases the time to swap wheels from one side of the gear box to the other. However, it may be desirable to design the shape of the bore and/or the wings such that either has a different shape that allows the shaft 410 or wheel 240 to turn at an angle other than 45°.

As illustrated in FIGS. 11 and 12, the bore 508 is designed such that the shaft 410 may turn clockwise or counter-clockwise within it. Furthermore, if the shaft 410 and wheel 240 are rotating in one direction and something prevents the wheel from rotating at the same speed as the shaft, the winged portions 502, 504 may tend to translate pass the opening 506. In order to prevent the winged portions 502, 504 from escaping the wheel 240 and to assist them in passing over the opening 506 to the other end of the bore 508, it may be preferable to design the winged portions such that they have a tapered profile.

Although the invention is described and illustrated with respect to the exemplary embodiments thereof, it should be understood by those skilled in the art that the foregoing and various changes, omissions and additions may be made without departing from the spirit and scope of the invention.

What is claimed is:

1. A panel seaming apparatus, comprising:

(a) a motor;

(b) a first gear box connected to said motor;

(c) a first wheel connected to said first gear box;

(d) a second wheel connected to said first gear box, said first and second wheels rotating in opposite directions and seaming two panels together as portions of the panels pass therebetween;

(e) a second gear box located downstream of and aligned with said first gear box along a particular axis, said second gear box connected to said first gear box via a universal joint, thereby allowing said first and second gear boxes to pivot amongst each other;

(f) a third wheel connected to said second gear box; and (g) a fourth wheel connected to said second gear box, said third and fourth wheels rotating in opposite directions and further seaming said panels together as the portions of the panels pass therebetween.

2. The panel seaming apparatus of claim 1 further comprising a, mechanical linkage system comprising:

a first link arm affixed to said first gear box;

a second link arm affixed to said second gear box; and a hinge pin connecting said first and second link arms to one another, wherein said first and second link arms pivot about said hinge pin.

3. The panel seaming apparatus of claim 2 wherein said hinge pin is aligned with said universal joint.

4. The panel seaming apparatus of claim 2 wherein said mechanical linkage system allows said first gear box and said second gear box to pivot amongst one another at a range of 0°to 90°.

5. The panel seaming apparatus of claim 4 wherein said mechanical linkage system allows said first gear box and said second gear box to pivot amongst one another at a range of 0° to 25°.

6. The panel seaming apparatus of claim 1 further comprising an idler roll located between said first and second gear boxes and contacting the seamed panel.

7. The panel seaming apparatus of claim 6 further comprising a second idler roll attached to said second gear box and contacting the seamed panel after it passes between said third and fourth wheels.

8. A panel seaming apparatus, comprising:

(a) a first gear box;

(b) a first wheel connected to said first gear box;

(c) a second wheel connected to said first gear box, said first and second wheels rotating in opposite directions and seaming two panels together as portions of the panels pass therebetween;

(d) a second gear box located downstream of said first gear box;

(e) a third wheel connected to said second gear box;

(f) a fourth wheel connected to said second gearbox, said third and fourth wheels rotating in opposite directions and further seaming said panels together as the portions of said panels pass therebetween;

(g) means for connecting said first gear box to said second gear box, wherein said connecting means comprises means for allowing said first and second gear box to pivot in relation to one another; and (h) means for driving both said first and second gear boxes with a single motor.

9. The panel seaming apparatus of claim 8 wherein said means for allowing said first and second gear boxes to pivot allows said gear boxes to pivot at an angle of 0° to 90° with respect to another.

10. The panel seaming apparatus of claim 9 wherein said means for allowing said first and second gear boxes to pivot allows said gear boxes to pivot at an angle of 0° to 25° with respect is to another.

11. A panel seaming apparatus, comprising:

(a) a gear box comprising a first portion, a second portion and a shaft mechanically linked to said first and second portions;

(b) means for driving said shaft;

(c) means for pivoting said first and second portions of said gear box in relation to one another;

(d) a first wheel connected to said first portion of said gear box; and (e) a second wheel connected to said second portion of said gear box, said first and second wheels rotating in opposite directions and seaming two panels together as portions of the panels pass therebetween.

12. The panel seaming apparatus of claim 11 wherein said gear box comprises a worm gear arrangement.

13. The panel seaming apparatus of claim 11 wherein said means, for driving said shaft comprises a motor.

14. The panel seaming apparatus of claim 13 wherein said means for driving said shaft further comprises a sprocket and chain arrangement connecting said motor and said shaft.

15. The panel seaming apparatus of claim 11 wherein said pivoting means comprises:

a control lever connected to and pivoting about said first gear box; and an extension arm comprising a first end and second end, said second end connected to said second portion of said gear box, and said first end connected to said control lever such that when said control lever pivots about said first portion of is said gear box, said first and second gear box portions pivot is amongst one another.

16. The panel seaming apparatus of claim 15 further comprising means for absorbing a sudden change in distance between said first and second wheels.

17. The panel seaming apparatus of claim 16 wherein said absorbing means comprises a compression spring included within said extension arm.

18. The panel seaming apparatus of claim 17 wherein said compression spring comprises a plurality of polyurethane springs separated by washers.

19. The panel seaming apparatus of claim 15 further comprising means for adjusting the length of said extension arm.

20. The seaming apparatus of claim 19 wherein said means for adjusting the length of said extension arm comprises a threaded rod arrangement included within said extension arm.

21. A panel seaming apparatus, comprising:

(a) a gear box comprising a first portion, a second portion and a shaft mechanically linked to said first and second portions;

(b) means for driving said shaft;

(c) a control lever connected to and pivoting about said first portion of said gear box, (d) an extension arm comprising a first end and second end, said second end connected to said second portion of said gear box, and said first end connected to said control lever such that when said control lever pivots about said first gear box, said first and second gear box portions pivot amongst one another, said extension arm comprising a compression spring;

(e) a first wheel connected to said first portion of said gear box; and (f) a second wheel connected to said second portion of said gear box, said first and second wheels rotating in opposite directions and seaming two panels together as portions of the panels pass therebetween.

22. The panel seaming apparatus of claim 21 wherein said compression spring comprises a plurality of polyurethane springs separated by washers.

23. A panel seaming apparatus, comprising:

(a) a motor;

(b) a gear box connected to said motor, said gear box comprising a first portion and a second portion;

(c) control lever connected to and pivoting about said first portion of said gear box;

(d) an extension arm comprising a first end and seconds end, said second end connected to said second portion of said gear box, and said first end connected to said control lever such that when said control lever pivots about said first portion of said gear box, said first and second gear box portions pivot amongst the another;

(e) a first wheel connected to said first portion of said gear box; and (f) a second wheel connected to said second portion of said gear box, said first and second wheels rotate in opposite directions and seam two panels together as portions of the panels pass therebetween.

24. The panel seaming apparatus of claim 23 further comprising a second gear box aligned with said gear box along a particular axis, said second gear box connected to said gear box via a universal joint, said second gear box comprising a first portion and a second portion;

a second control lever connected to and pivoting about said first portion of said second gear box;

a second extension arm comprising a first end and second end, said second end connected to said second portion of said second gear box, and said first end connected to said second control lever such that when said second control lever pivots about said first portion of said second gear box, said first and second gear box portions of said second gear box pivot amongst one another;

(e) a third wheel connected to said first portion of said second gear box; and (f) a fourth wheel connected to said second portion of said second gear box, said third and fourth wheels rotate in opposite directions and further seam two panels together as the portions of the panels pass therebetween.

25. A panel seaming apparatus, comprising:

(a) a gear box;

(b) means for driving said gear box;

(c) a first shaft comprising a first end and a second end, said first end connected to said gear box, said second end comprising at least two winged portions;

(d) a first wheel comprising a first hub, said first hub comprising (1) a first opening for receiving said second end of said first shaft; and (2) a complementary shaped first bore for allowing said second end to turn within said first wheel after entering through said opening;

(e) a second shaft comprising a first end and a second end, said first end connected to said gear box, said second end comprising at least two winged portions; and (d) a second wheel comprising a second hub, said second hub comprising (1) a second opening for receiving said second end of said second shaft; and (2) a complementary shaped second bore for allowing said second end of said second shaft to turn within said second wheel after entering through said second opening, said first and second wheels rotate in opposite directions and seam two panels together as portions of the panels pass therebetween.

26. The panel seaming apparatus of claim 25 wherein said first and second wheels further comprise ball plungers such that when said second ends of said first and second shafts turn within said respective bores, said winged portions pass over said ball plungers, which prevent said winged portions from turning in an alternate direction.

27. The panel seaming apparatus of claim 26 wherein said first and second shafts turn about 45° before said winged portions completely pass over said ball plungers.

28. The panel seaming apparatus of claim 26 wherein said winged portions of said first and second shafts are adjacent a side of said first and second bores, respectively, after passing over said ball plungers.

29. The panel seaming apparatus of claim 25 wherein said first and second bores have a butterfly shape.

30. The panel seaming apparatus of claim 25 wherein said winged portions of said first and second shafts have a tapered profile.

* * * * *